US006224031B1

(12) United States Patent
Boeshart

(10) Patent No.: US 6,224,031 B1
(45) Date of Patent: May 1, 2001

(54) TIE WITH HINGED END PLATES

(76) Inventor: Patrick E. Boeshart, P.O. Box 774, Sioux City, IA (US) 51102

( * ) Notice: Subject to any disclaimer, the term of this patent is extended or adjusted under 35 U.S.C. 154(b) by 0 days.

(21) Appl. No.: 09/311,180

(22) Filed: May 13, 1999

(51) Int. Cl.[7] ..... E04G 17/02; E04G 17/12

(52) U.S. Cl. ..... 249/214; 249/40; 249/41; 249/190; 249/191; 249/213; 52/426; 52/562; 52/700; 52/714; 411/340

(58) Field of Search ..... 249/40, 41, 45, 249/190, 191, 213, 214, 216, 218; 52/98, 426, 428, 562, 564, 565, 568, 700, 714; 411/340, 345

(56) References Cited

U.S. PATENT DOCUMENTS

| | | | | |
|---|---|---|---|---|
| 1,963,514 | * | 6/1934 | Wherren | 249/42 |
| 2,205,662 | * | 6/1940 | La Grotta | 249/218 |
| 3,430,913 | * | 3/1969 | Johnson | 249/190 X |
| 3,469,815 | * | 9/1969 | Brenneman | 249/41 |
| 3,900,925 | * | 8/1975 | La Torraca | 24/90.1 |
| 3,985,329 | * | 10/1976 | Liedgens | 249/40 |
| 4,154,362 | | 5/1979 | McKenney . | |
| 4,229,930 | * | 10/1980 | Ostermaier | 54/79.2 |
| 4,563,381 | | 1/1986 | Woodland . | |
| 4,657,461 | * | 4/1987 | Smith | 411/340 |
| 4,731,968 | * | 3/1988 | Obino | 52/426 X |
| 4,765,109 | * | 8/1988 | Boeshart | 52/426 |
| 4,865,501 | * | 9/1989 | Ferris | 411/340 |
| 5,039,058 | | 8/1991 | Boeshart . | |
| 5,226,767 | * | 7/1993 | Foerster, Jr. | 411/340 |
| 5,890,337 | * | 4/1999 | Boeshart | 52/426 |

* cited by examiner

*Primary Examiner*—Laura A. Callo
(74) *Attorney, Agent, or Firm*—Koley Jessen P.C. A Limited Liability Organization; Mark D. Frederiksen

(57) ABSTRACT

A tie includes an elongated strap with an end plate pivotally connected at each end of the strap, permitting the end plate to be pivoted from a position generally orthogonal to the strap, to a position generally parallel to the strap. Once an end plate is pivoted to a position parallel to the strap, the end plate can be pushed through a polystyrene form panel to project therefrom. The end plate is then pivoted to the position orthogonal to the strap, and pulled into engagement with the outward face of the form panel. The second end plate on the tie is pivoted, pushed through a second form panel, pivoted to the orthogonal position, and thence the second form panel is pulled outwardly into contact with the second end plate. In this way, the tie will interconnect a pair of parallel form panels in spaced apart position, to receive poured concrete therebetween.

15 Claims, 3 Drawing Sheets

TIE WITH HINGED END PLATES

CROSS-REFERENCES TO RELATED APPLICATIONS (Not applicable).

STATEMENT AS TO RIGHTS TO INVENTIONS MADE UNDER FEDERALLY SPONSORED RESEARCH AND DEVELOPMENT (Not applicable).

BACKGROUND OF THE INVENTION (1) Field of the Invention

The present invention relates generally to ties for connecting form panels to create a poured concrete wall system, and more particularly to an improved tie which is, mechanically operable to be inserted through a form panel and then manipulated to retain the form panel in position.

(2) Background Information

A popular wall forming system utilizes expanded polystyrene panels as forms for poured concrete walls. After the concrete has hardened, the panels may be left in place on the walls to serve as permanent insulation, or they may be stripped off to reveal the exposed concrete and permit reuse of the form panels.

Initially, these lightweight form systems utilize elongated one foot high sheets with tie slots formed along the upper and lower edges. The panels then were connected by plastic ties, both in parallel, and stacked vertically.

One problem with most previous tie designs was in a situation where a large four foot by eight foot panel is desired to be used as the form. Because most previous tie designs were utilized in slots along the upper and lower edges, it was not possible to insert a tie intermediate the edges of the panel, without creating large holes in the panel.

Another problem with prior art forming systems was in the use of ties which would retain the insulation panel permanently on the wall. Such systems were not capable of use on those occasions where an exposed concrete surface is desired, or where reuse of the form panels is necessary.

BRIEF SUMMARY OF THE INVENTION

It is therefore a general object of the present invention to provide an improved tie for use with polystyrene sheets used as form panels for poured concreted walls.

Another object of the present invention is to provide a tie which may be inserted through the intermediate portion of a polystyrene form panel to retain the form panel in position.

A further object is to provide a concrete wall form tie which has an end plate which may be removed to permit removal of the form panel after the concrete has cured.

These and other objects of the present invention will be apparent to those skilled in the art.

The tie of the present invention includes an elongated strap with an end plate pivotally connected at each end of the strap, permitting the end plate to be pivoted from a position generally orthogonal to the strap, to a position generally parallel to the strap. Once an end plate is pivoted to a position parallel to the strap, the end plate can be pushed through a polystyrene form panel to project therefrom. The end plate is then pivoted to the position orthogonal to the strap, and pulled into engagement with the outward face of the form panel. The second end plate on the tie is pivoted, pushed through a second form panel, pivoted to the orthogonal position, and thence the second form panel is pulled outwardly into contact with the second end plate. In this way, the tie will interconnect a pair of parallel form panels in spaced apart position, to receive poured concrete therebetween.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
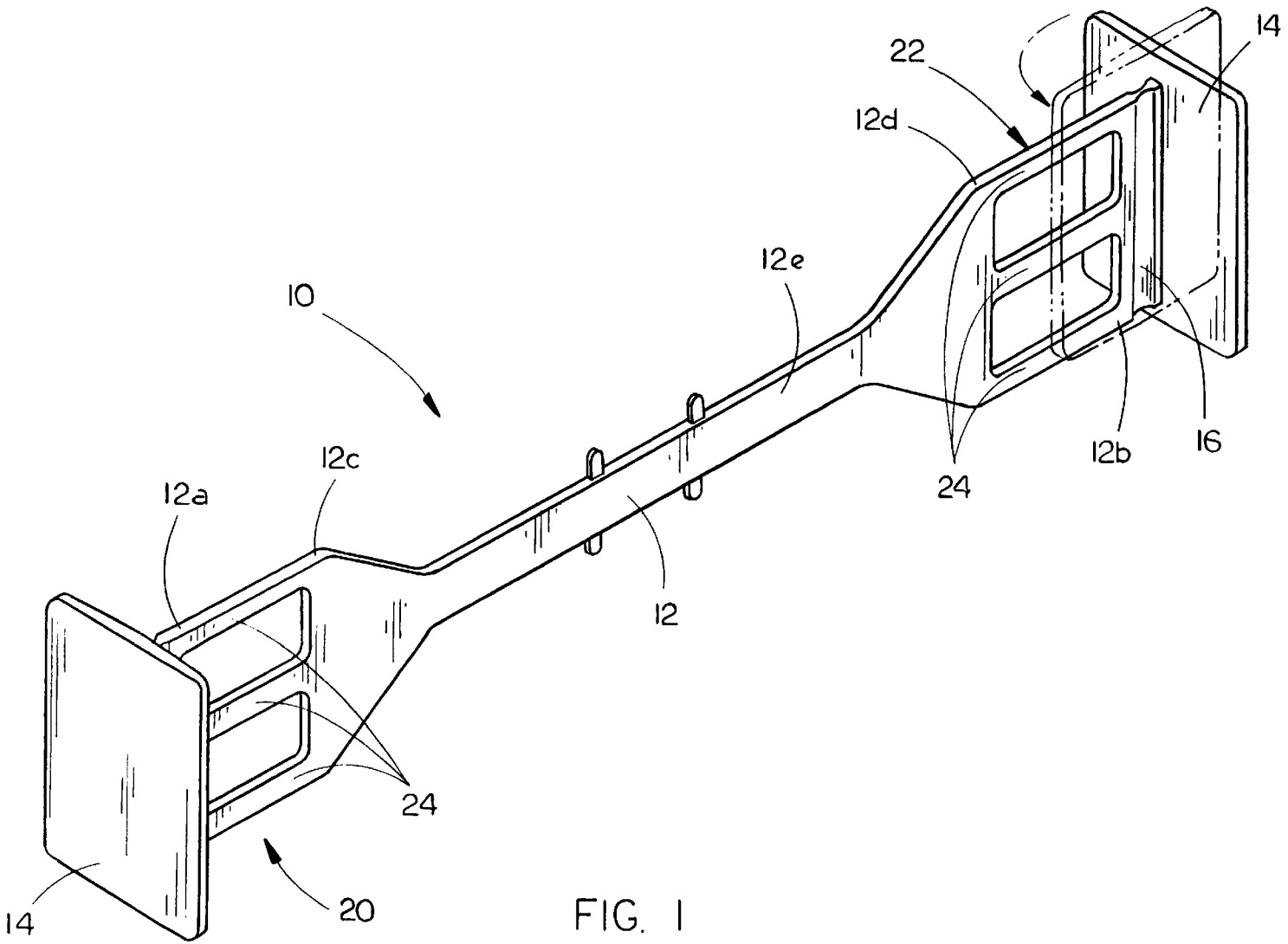
FIG. 1 is a perspective view of the tie of the present invention.

Referring now to the drawings, and more particularly to FIG. 1, the tie of the present invention is designated generally at 10 and includes an elongated strap 12 of a synthetic plastic material. Preferably, strap 10 is of a thin material, so as to have a height substantially greater than its thickness. Strap 12 includes opposing ends 12*a* and 12*b*, each end having an end plate 14 operably mounted thereon with a hinge 16. Preferably, end plate 14 and hinge 16 are also formed of synthetic plastic material, such that tie 10 is a single integral piece. In this case, hinge 16 is a "living hinge" formed of a thinned plastic joint between each end plate 14 and the associated strap end 12*a* and 12*b*. Hinges 16 are oriented vertically, such that end plate 14 may be pivoted from a first position oriented generally orthogonal to the longitudinal axis of the strap 12, as shown at end 12*a*, to a position generally parallel to the longitudinal axis of strap 12, as shown at end 12*b*. End plates 14 are mounted on hinges 16 along a vertical axis located generally centrally between side edges 14*a* and 14*b*, to permit pivoting of the end plate 14 in either direction. As shown in FIG. 1, the thickness of each end plate 14 diminishes from the center, along the hinge, to the vertical side edges.

Strap 12 preferably has a height, measured between upper and lower edges, which is constant from the outer ends 12*a* and 12*b* to an interior point identified generally at 12*c* and 12*d* respectively. The distance from the end 12*a* to the interior point 12*c* is preferably equal to the thickness of a form panel 18 (shown in FIG. 2) through which the tie 10 will be inserted. The overall height of strap 12 preferably is reduced from interior points 12*c* and 12*d* so that the intermediate portion 12*e* of strap 12 is of a relatively short height, approximately one-fourth the height of the end portions of the strap.

The end sections of strap 12, identified generally at 20 and 22 respectively, located between strap end 12*a* and inward point 12*c*, and strap end 12*b* and inward point 12*d*, respectively, are preferably formed of a plurality of elongated parallel spaced apart legs 24. As described in more detail hereinbelow, the use of spaced apart legs 24 permits simpler and cleaner removal of the legs where it is desired to remove the form panels from the poured concrete wall. In use, a form panel 18 is preferably marked with locations for the installation of ties 10. One end plate 14 is then pivoted to a position parallel to strap 12 and manually pushed through the form panel to project out the opposite side of the form panel. The end plate 14 is then repositioned to an orientation orthogonal to the strap 12 and the form panel 18 is pushed outwardly against the inward face of end plate 14. The same procedure is utilized for the opposite end of the tie, so that each tie 10 will retain form panels 18 from outward movement along the longitudinal axis of the strap 12.

As concrete is poured between the form panels 18, the pressure of the concrete will maintain the form panels forced outwardly against end plates 14. Once the concrete is cured, the form panels 18 may either be left in place to insulate the concrete wall, or they may be removed, as described hereinbelow.

Figure 2:
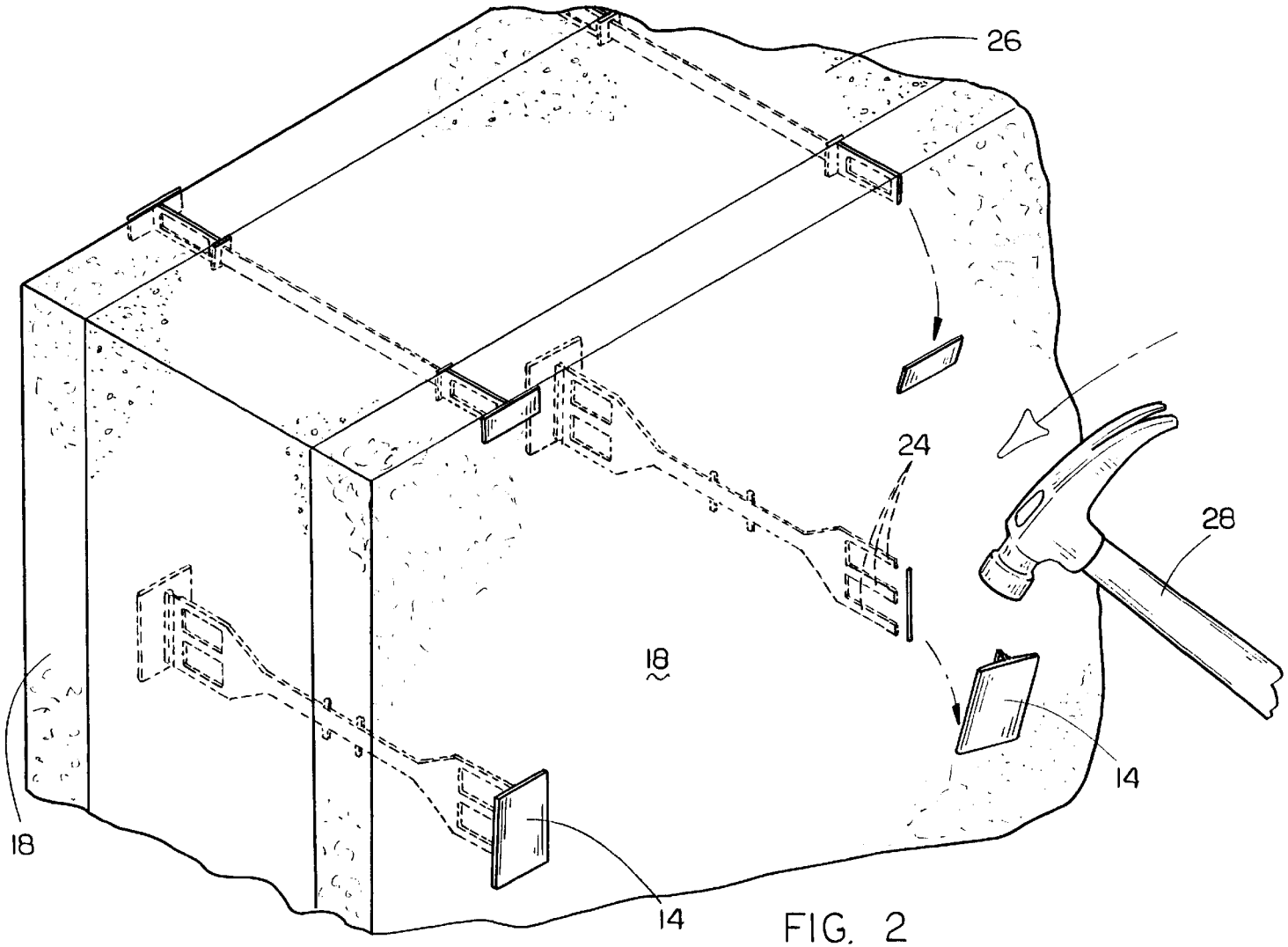
FIG. 2 is a perspective view of a wall utilizing the ties of the forming system thereon, showing how the outer plate of the tie may be removed.
Figure 3:
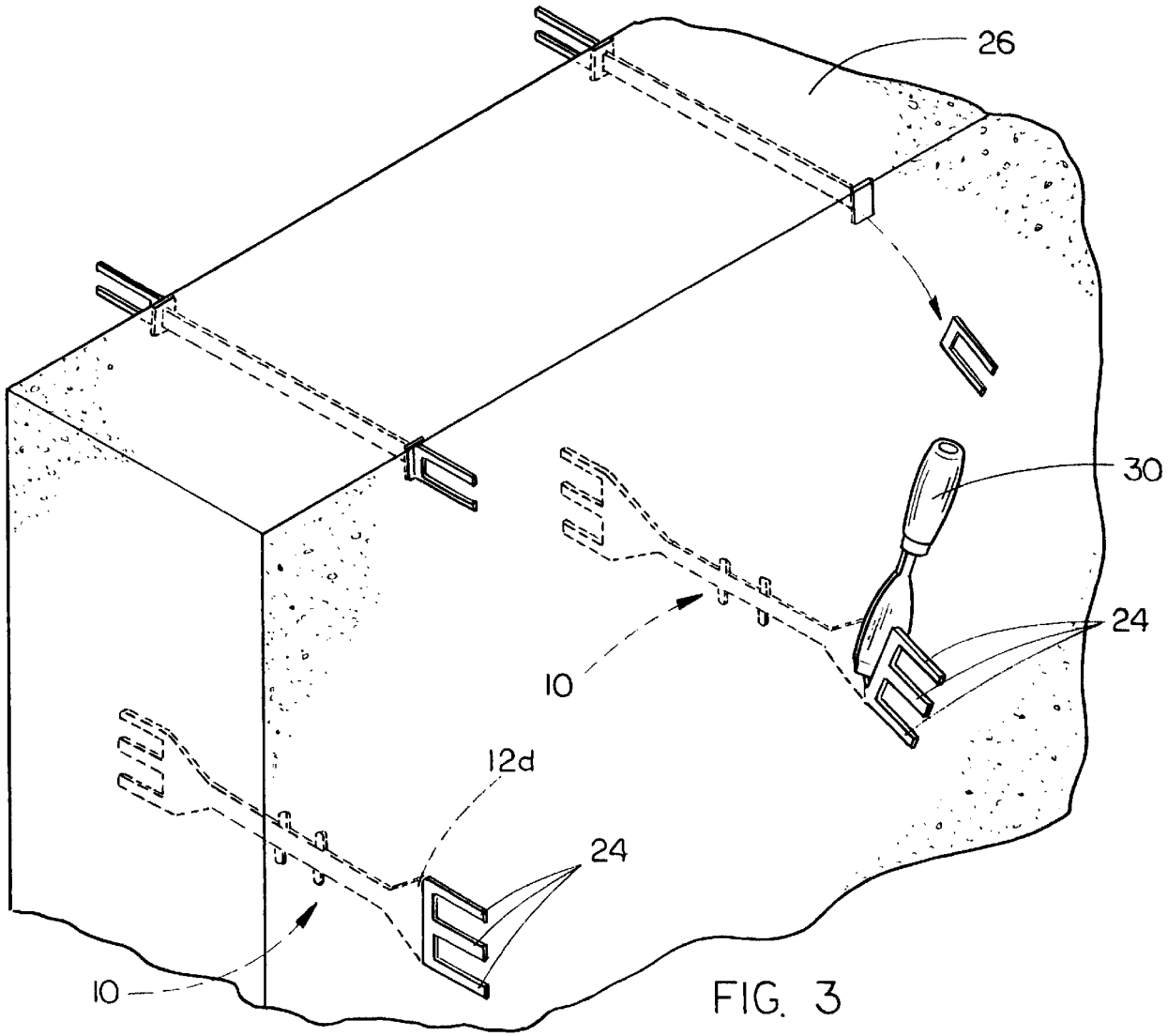
FIG. 3 is a perspective view of the wall of FIG. 2 with the form panels removed, showing the removal of the projecting ends of the ties.

Referring now to FIGS. 2–3, the drawings show how the form panels 18 may be removed from a hardened concrete wall 26. FIG. 2 shows how a hammer 28 may be used to apply a sharp vertical blow to the end plate 14, which is exposed on the outside surface of each form panel 18. Because of the small cross-section of legs 24, and the use of the synthetic plastic material, legs 24 will readily break, allowing end plates 14 to fall to the ground. Once end plates 14 are removed from one entire panel 18, the panel may be pulled outwardly away from wall 26 and removed.

FIG. 3 shows concrete wall 26, with panels 18 removed, leaving portions of broken legs 24 projecting outwardly therefrom. Because form panels 18 have a smooth intersurface, they do not adhere to the concrete wall and are easily removed. A conventional scraper 30 is shown in use knocking off the remaining portions of the exposed tie 10—namely, legs 24. Scraper 30 is used to apply a sharp blow to each of legs 24, which breaks the legs at their connection to the end of the tie strap at inward point 12*c* or 12*d*. Once removed, only the cross-section of the tie strap remains.

Whereas the invention has been shown and described in connection with the preferred embodiment thereof, many modifications, substitutions and additions may be made which are within the intended broad scope of the appended claims.

I claim:

1. A tie for interconnecting a pair of parallel form panels, comprising:

an elongated strap having opposing first and second ends, and a longitudinal axis;

a first end plate pivotally connected to the strap first end for pivotal movement between a first position substantially orthogonal to the strap longitudinal axis, and a second position substantially parallel to the strap longitudinal axis;

a vertically oriented hinge pivotally connecting the first end plate to the strap first end;

the strap first end including a plurality of parallel, vertically spaced apart, horizontally extending legs having a small vertical cross-section adapted to break easily upon application of a dynamic force thereto, each said leg having an inward end connected together along a generally vertical axis, and an outward end connected to the hinge;

a second end plate mounted n the strap second end, oriented generally orthogonal to the strap longitudinal axis;

said strap, hinge and first end plate being formed of a synthetic plastic material and formed as a single integral unit; and said hinge being a thin plastic living hinge.

2. The tie of claim 1, wherein said first and second end plates are generally flat, planar members, having inward and outward faces, the inward face being connected to said strap.

3. The tie of claim 1, wherein said second end plate is pivotally connected to the strap second end, for pivotal movement between a first position substantially orthogonal to the strap longitudinal axis, and a second position substantially parallel to the strap longitudinal axis.

4. The tie of claim 1, further comprising a second vertically oriented hinge pivotally connecting the second end plate to the strap second end.

5. The tie of claim 4, wherein the second end plate and second hinge are of the same plastic material as the strap, first end plate and first hinge, wherein the second hinge is a thin plastic living hinge, and wherein the tie is formed of as a single integral unit.

6. A tie for interconnecting a pair of parallel form panels, comprising:

an elongated strap having opposing first and second ends, and a longitudinal axis;

a first end plate pivotally connected to the strap first end for pivotal movement between a first position substantially orthogonal to the strap longitudinal axis, and a second position substantially parallel to the strap longitudinal axis;

a second end plate mounted on the strap second end, oriented generally orthogonal to the strap longitudinal axis;

a vertically oriented thin plastic living hinge pivotally connecting the first end plate to the strap first end;

said strap, hinge and first end plate being formed of a synthetic plastic material and formed as a single integral unit;

said first and second end plates being generally flat, planar members, having inward and outward faces, the inward face being connected to said strap;

said second end plate being pivotally connected to the strap second end, for pivotal movement between a first position substantially orthogonal to the strap longitudinal axis and a second position substantially parallel to the strap longitudinal axis;

a second vertically oriented thin plastic living hinge pivotally connecting the second end plate to the strap second end;

the second end plate and second hinge being of the same plastic material as the strap, first end plate and first hinge, said tie being formed of as a single integral unit;

each end of the strap including a plurality of parallel, vertically spaced apart, horizontally extending legs having a small vertical cross-section adapted to break easily upon application of a dynamic force thereto, each said leg having an inward end connection together along a generally vertical axis, and an outward end connected to the hinge.

7. The tie of claim 6, wherein each said end plate includes opposing, generally vertical side edges, and wherein the thickness of each plate diminishes from a central portion of the plate to the side edges of the plate.

8. A tie for interconnecting a pair of parallel spaced apart form panels, comprising:

an elongated strap having opposing first and second ends and a longitudinal axis;

first hinge means on the strap first end for pivotally connecting an end panel thereto;

second hinge means on the strap second end for pivotally connecting an end plate thereto;

a first generally flat, planar end plate connected to the first hinge means for pivotal movement between a first position substantially orthogonal to the strap longitudinal axis, and a second position substantially parallel to the strap longitudinal axis; and a second generally flat, planar end plate connected to the second hinge means for pivotal movement between a first position substantially orthogonal to the strap longitudinal axis, and a second position substantially parallel to the strap longitudinal axis;

each end plate including opposing, generally vertical side edges, and wherein the thickness of each end plate diminishes from a central location of the plate of the side edges of the plate.

9. The tie of claim 8, wherein said hinge means are oriented vertically and parallel to one another.

10. The tie of claim 8, wherein said strap, end plates, and hinge means are all formed of a synthetic plastic material and are all formed as a single integral unit.

11. A method for connecting a tie to a form panel, comprising the steps of:

providing at least a first and second form panel, each form panel having peripheral edges, for interconnection by at least one tie in parallel, spaced apart relationship;

providing a tie for interconnecting the form panels, said tie of a type having an elongated strap with first and second end plates, one end plate on each end of said strap, and at least the first end plate being pivotally mounted on the strap;

pivoting the first end plate to a position parallel to the strap;

forming an opening through a thickness of the first form panel, between an inward face and an outward face of the form panel and spaced from the peripheral edge;

pushing the pivoted first end plate and a portion of the strap through the opening from the inward face so as to project out past the outward face of the first form panel;

pivoting the pivoted first end plate to a position orthogonal to the strap; and pulling the strap inwardly, to draw the first end plate into engagement with the outward face of the first form panel.

12. The method of claim 11, further comprising the steps of:

providing a plurality of additional ties, each tie of a type having an elongated strap with first and second end plates, one end plate on each end, and at least the first end plate being pivotally mounted on the strap;

pivoting the first end plate of one of said plurality of ties to a position parallel with the strap;

forming an opening through the thickness of the first form panel;

pushing the pivoted first end plate of said one tie through the opening from the inwardly face to project out past the outward face of the first form panel;

pivoting the pivoted first end plate to a position orthogonal to the strap of the said one tie;

pulling the strap of said one tie inwardly to draw the first end plate into engagement with the outward face of the first form panel; and repeating the steps of pivoting the first end plate, forming an opening, pushing the pivoted end plate, pivoting the pivoted first end plate, and pulling the strap, for each of said plurality of ties.

13. The method of claim 11, wherein said first form panel is formed of a synthetic plastic material, and wherein the step of forming the opening is accomplished simultaneously with the step of pushing the pivoted first end plate through the opening, by pushing the first end plate directly through the form panel material to project out the outward face.

14. The method of claim 11, wherein said tie second end plate is pivotally mounted to the strap, and further comprising the steps of:

pivoting the second end plate to a position parallel to the strap;

forming an opening through a thickness of the second form panel, between an inward face and an outward face thereof, and spaced from the peripheral edge;

pushing the pivoted second end plate and a portion of the strap through the opening from the inward face, to project out past the outward face of the second form panel;

pivoting the pivoted second end plate to a position orthogonal to the strap; and pulling the second form panel outwardly to draw the second end plate into engagement with the outward surface of the second form panel.

15. A method for interconnecting a pair of first and second synthetic plastic form panels in parallel spaced apart relationship with a plurality of ties, the ties of the type having an elongated strap, a first end plate pivotally connected to a first end of the strap, and a second end plate pivotally connected to a second end of the strap, comprising the steps of:

pivoting the first end plate of one of said ties to a position parallel to the strap;

pushing the pivoted first end plate through an inward face of the first form panel until it projects outwardly from an outward face of the first form panel;

pivoting the pivoted first end plate to a position orthogonal to the strap;

pulling the one said tie strap inwardly to engage the first end plate with the outward face of the first form panel;

repeating the steps of pivoting the first end plate, pushing the pivoted first end plate, pivoting the pivoted first end plate, and pulling the strap, for each of said plurality of ties;

after accomplishing the repeating step, thence:

pivoting the second end plate of one of said ties to a position parallel to the strap;

pushing the pivoted second end plate through an inward face of the second form panel such that it projects outwardly from an outward face of the second form panel;

pivoting the pivoted second end plate to a position orthogonal to the strap;

repeating the pivoting the second end plate, pushing the second end plate, and pivoting the pivoted second end plate steps for each of said ties; and thence pulling the second form panel outwardly into contact with all of the tie second end plates, parallel to the first form panel.

* * * * *